US011281165B2

(12) United States Patent
Hirokawa et al.

(10) Patent No.: US 11,281,165 B2
(45) Date of Patent: Mar. 22, 2022

(54) ELECTRONIC TIMEPIECE, METHOD OF DISPLAY CONTROL, AND STORAGE MEDIUM

(71) Applicant: CASIO COMPUTER CO., LTD., Tokyo (JP)

(72) Inventors: Jyunichi Hirokawa, Tokyo (JP); Tatsuyoshi Omura, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 785 days.

(21) Appl. No.: 16/180,439

(22) Filed: Nov. 5, 2018

(65) Prior Publication Data

US 2019/0137945 A1 May 9, 2019

(30) Foreign Application Priority Data

Nov. 8, 2017 (JP) ..... JP2017-215653

(51) Int. Cl.
*G04G 9/00* (2006.01)
*G09G 3/36* (2006.01)
*G04G 7/00* (2006.01)

(52) U.S. Cl.
CPC ..... *G04G 9/0047* (2013.01); *G04G 7/026* (2013.01); *G04G 9/0011* (2013.01); *G09G 3/3614* (2013.01); *G09G 3/3648* (2013.01)

(58) Field of Classification Search
CPC .... G04G 7/026; G04G 9/0011; G04G 9/0047; G09G 3/3614; G09G 3/3648
See application file for complete search history.

(56) References Cited

U.S. PATENT DOCUMENTS 3,701,249 A * 10/1972 Bergey ..... G04G 9/12 368/84
6,501,455 B1 * 12/2002 Nakamura ..... G09G 3/3685 345/96
2009/0219238 A1 * 9/2009 Furuya ..... G09G 3/3655 345/87
2009/0295450 A1 * 12/2009 Sugita ..... H03M 7/20 327/299

(Continued)

FOREIGN PATENT DOCUMENTS

JP 2003-177717 A 3/2003
JP 2009-223289 A 10/2009
JP 6798470 B2 12/2020

OTHER PUBLICATIONS

Japanese Office Action dated Feb. 1, 2022 in a counterpart Japanese patent application No. 2020-191354.

*Primary Examiner* — Daniel P Wicklund
(74) *Attorney, Agent, or Firm* — Chen Yoshimura LLP

(57) ABSTRACT

In the case where a ticking timing of a clock unit changes, a CPU of an electronic timepiece outputs a synchronization request signal to a CPU of a display module at the next ticking timing after the change so as to request resynchronization. Each time a timer circuit counts a prescribed number of pulses in a clock signal generated by a clock generation circuit on the basis of the ticking timing, the CPU of the display module instructs a liquid crystal driver circuit to invert the polarity of an AC voltage to be applied to a liquid crystal panel. Moreover, upon receiving the synchronization request signal from the CPU of the electronic timepiece, the CPU of the display module sets the timer circuit to start a new count of the clock.

8 Claims, 13 Drawing Sheets

(56) References Cited

U.S. PATENT DOCUMENTS

| | | | | |
|---|---|---|---|---|
| 2010/0289731 | A1* | 11/2010 | Matsumoto | G09G 3/3648 345/87 |
| 2011/0043483 | A1* | 2/2011 | Mizuhashi | G06F 1/3203 345/174 |
| 2014/0028645 | A1* | 1/2014 | Yamazaki | G09G 3/36 345/209 |
| 2014/0368488 | A1* | 12/2014 | Hatsu | G09G 3/3648 345/212 |
| 2017/0315659 | A1* | 11/2017 | Kuroiwa | G09G 3/3677 |
| 2019/0137945 | A1* | 5/2019 | Hirokawa | G04G 7/026 |
| 2019/0386665 | A1* | 12/2019 | Shalita | G04F 10/005 |
| 2020/0019127 | A1* | 1/2020 | Klopfenstein | G04G 5/027 |

* cited by examiner

ELECTRONIC TIMEPIECE, METHOD OF DISPLAY CONTROL, AND STORAGE MEDIUM

BACKGROUND OF THE INVENTION

This technical field relates to an electronic timepiece, a method of display control, and a storage medium.

In the field of liquid crystal display devices including a liquid crystal panel in which a plurality of pixels for displaying an image are arranged, there exist conventional technologies for reducing the power consumption of the liquid crystal panel by storing image data in memory elements built into the pixels and thereby reducing image rewrite frequency (see Japanese Patent Application Laid-Open Publication No. 2003-177717, for example).

In a liquid crystal display device of the type disclosed in the above patent document, using a DC voltage to drive the liquid crystal panel shortens the lifespan of the panel, and therefore the liquid crystal panel is typically driven using an AC voltage whose polarity is inverted at a prescribed interval. However, when the timing at which image data is output to the pixels overlaps with the timing at which the polarity of the AC voltage is inverted, the image data is not stored in the memory elements of the pixels correctly, which can negatively affect the reliability of the liquid crystal panel.

SUMMARY OF THE INVENTION

Accordingly, the present invention is directed to a scheme that substantially obviates one or more of the problems due to limitations and disadvantages of the related art. An electronic timepiece, a method of display control, and a storage medium are disclosed herein.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic timepiece, including: a clock unit that keeps time, the clock unit repeatedly and periodically generating a ticking event at a prescribed ticking timing, the prescribed ticking timing being adjustable so as to correct the time kept by the clock unit; a first processor that controls the clock unit; a clock generation circuit that outputs a clock signal of a prescribed frequency in accordance with every ticking timing of the clock unit; a timer circuit that repeatedly counts pulses in the clock signal output from the clock generation circuit up to a prescribed number of pulses that corresponds to the prescribed frequency; a liquid crystal driver circuit that drives a liquid crystal panel; and a second processor that controls the timer circuit and the liquid crystal driver circuit, the second processor causing the liquid crystal driver circuit to invert a polarity of an AC voltage to be applied to the liquid crystal panel and apply the inverted AC voltages to the liquid crystal panel each time the timer circuit counts up the prescribed number of pulses in the clock signal, wherein when the ticking timing of the clock unit is adjusted and changed, the first processor outputs a synchronization request signal to the second processor at a next ticking timing of the clock unit that occurs after the change in the ticking timing, so as to request the second processor to perform resynchronization, and wherein upon receipt of the synchronization request signal from the first processor, the second processor resets the timer circuit so that the timer circuit starts a new count of pulses in the clock signal.

In another aspect, the present disclosure provides a method of display control performed by an electronic timepiece that includes: a clock unit that keeps time, the clock unit repeatedly and periodically generating a ticking event at a prescribed ticking timing, the prescribed ticking timing being adjustable so as to correct the time kept by the clock unit; a first processor that controls the clock unit; a clock generation circuit that outputs a clock signal of a prescribed frequency in accordance with every ticking timing of the clock unit; a timer circuit that repeatedly counts pulses in the clock signal output from the clock generation circuit up to a prescribed number of pulses that corresponds to the prescribed frequency; a liquid crystal driver circuit that drives a liquid crystal panel; and a second processor that controls the timer circuit and the liquid crystal driver circuit, the method including: via the second processor, causing the liquid crystal driver circuit to invert a polarity of an AC voltage to be applied to the liquid crystal panel and apply the inverted AC voltages to the liquid crystal panel each time the timer circuit counts up the prescribed number of pulses in the clock signal; when the ticking timing of the clock unit is adjusted and changed, causing the first processor to output a synchronization request signal to the second processor at a next ticking timing of the clock unit that occurs after the change in the ticking timing, so as to request the second processor to perform resynchronization; and causing the second processor, upon receipt of the synchronization request signal from the first processor, to reset the timer circuit so that the timer circuit starts a new count of pulses in the clock signal.

In another aspect, the present disclosure provides a computer-readable non-transitory storage medium having stored a program executable by an electronic timepiece that includes: a clock unit that keeps time, the clock unit repeatedly and periodically generating a ticking event at a prescribed ticking timing, the prescribed ticking timing being adjustable so as to correct the time kept by the clock unit; a first processor that controls the clock unit; a clock generation circuit that outputs a clock signal of a prescribed frequency in accordance with every ticking timing of the clock unit; a timer circuit that repeatedly counts pulses in the clock signal output from the clock generation circuit up to a prescribed number of pulses that corresponds to the prescribed frequency; a liquid crystal driver circuit that drives a liquid crystal panel; and a second processor that controls the timer circuit and the liquid crystal driver circuit, the program being configured to cause the electronic timepiece to perform the following: via the second processor, causing the liquid crystal driver circuit to invert a polarity of an AC voltage to be applied to the liquid crystal panel and apply the inverted AC voltages to the liquid crystal panel each time the timer circuit counts up the prescribed number of pulses in the clock signal; when the ticking timing of the clock unit is adjusted and changed, causing the first processor to output a synchronization request signal to the second processor at a next ticking timing of the clock unit that occurs after the change in the ticking timing, so as to request the second processor to perform resynchronization; and causing the second processor, upon receipt of the synchronization request signal from the first processor, to reset the timer circuit so that the timer circuit starts a new count of pulses in the clock signal.

It is to be understood that both the foregoing general description and the following detailed description are exemplary and explanatory, and are intended to provide further explanation of the invention as claimed.

DETAILED DESCRIPTION OF THE INVENTION

Next, embodiments of the present invention will be described with reference to figures.

Figure 1:
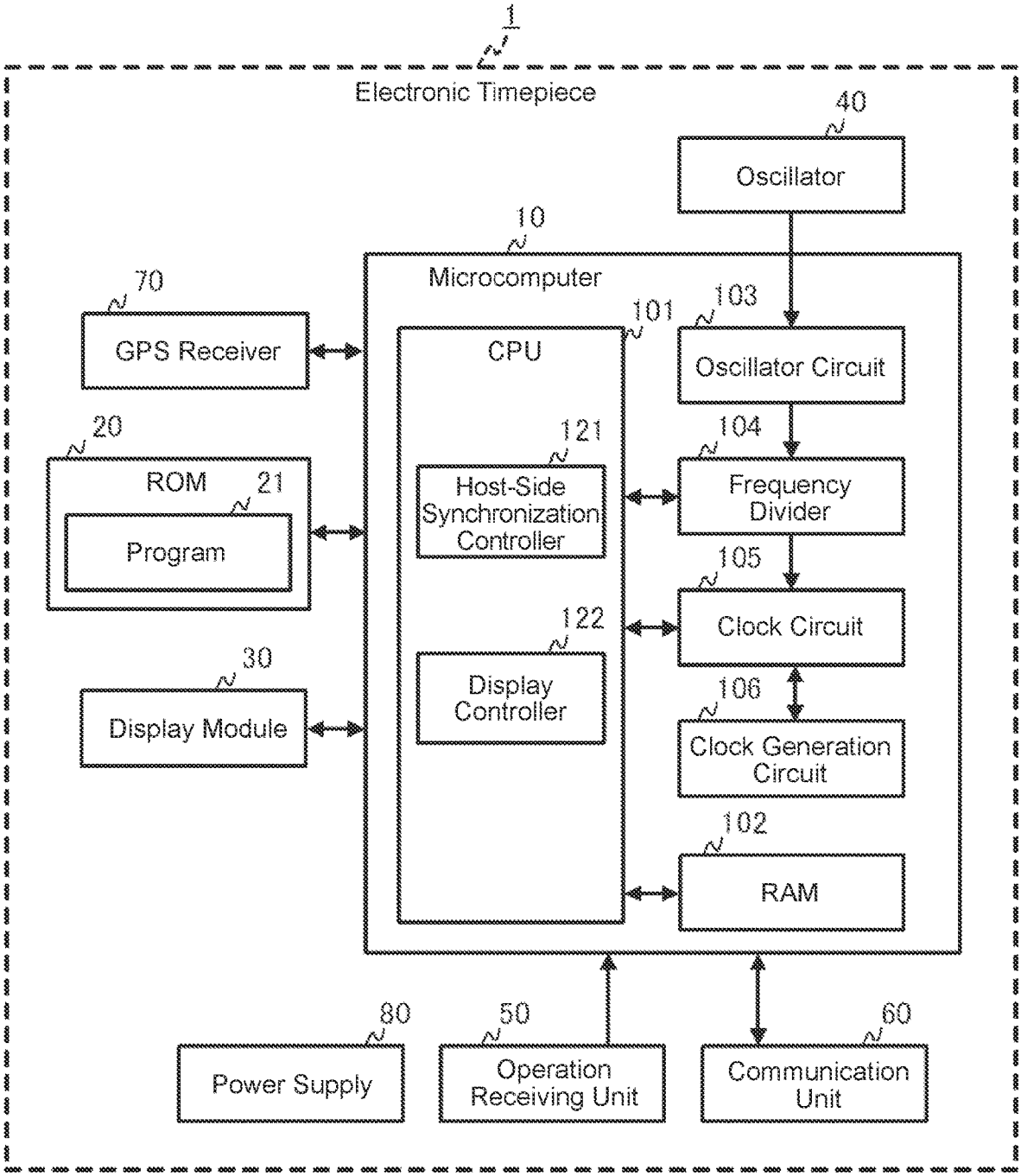
FIG. 1 illustrates an example of the configuration of an electronic timepiece according to an embodiment.

FIG. 1 illustrates an example of the configuration of an electronic timepiece 1 according to one embodiment of the present invention. First, the hardware configuration of the electronic timepiece 1 will be described. As illustrated in FIG. 1, the electronic timepiece 1 includes a microcomputer 10, a read-only memory (ROM) 20, a display module 30, an oscillator 40, an operation receiving unit 50, a communication unit 60, a GPS receiver 70, and a power supply 80.

The microcomputer 10 includes a central processing unit (CPU) 101 (a first CPU), a random-access memory (RAM) 102, an oscillator circuit 103, a frequency divider 104, a clock circuit 105, and an 8 Hz clock generation circuit 106. Note here that the RAM 102, the oscillator circuit 103, the frequency divider 104, the clock circuit 105, and the clock generation circuit 106 are not limited to being provided within the microcomputer 10 and may alternatively be provided outside of the microcomputer 10. Similarly, the ROM 20, the display module 30, the oscillator 40, the operation receiving unit 50, the communication unit 60, the GPS receiver 70, and the power supply 80 are not limited to being provided outside of the microcomputer 10 and may alternatively be provided inside of the microcomputer 10.

The CPU 101 is a processor which performs various types of calculation processes and is responsible for controlling the overall operation of the electronic timepiece 1. The CPU 101 reads control programs from the ROM 20 and loads these programs into the RAM 102 to execute various types of operation processes such as calculation control processes and display control processes related to various features.

The RAM 102 is volatile memory such as static random-access memory (SRAM) or dynamic random-access memory (DRAM). The RAM 102 transitorily stores data and also stores various types of configuration data. The RAM 102 further stores image data to be output to the display module 30. In the present embodiment, this image data is image data that represents the date, the day of the week, the current time, and the remaining battery level, for example.

The oscillator circuit 103 makes the oscillator 40 oscillate to generate and output a signal of prescribed frequency (a clock signal).

The frequency divider 104 divides this signal of prescribed frequency input from the oscillator circuit 103 into signals of frequencies used by the clock circuit 105 and the CPU 101 and then outputs the resulting signals. The frequencies of these output signals may be changed on the basis of settings configured by the CPU 101.

The clock circuit 105 counts the number of times that the signal input from the frequency divider 104 is input and adds this count to an initial value in order to keep the current time. Here, the clock circuit 105 may be implemented in the form of software that changes a value stored in the RAM 102 or may be implemented in the form of dedicated hardware. The time kept by the clock circuit 105 may be any of a cumulative time since some prescribed point in time, Coordinated Universal Time (UTC), the time in a prescribed city (local time), or the like. Moreover, the time kept by the clock circuit 105 does not necessarily need to be in year/month/day hour:minute:second format.

In the present embodiment, the oscillator circuit 103, the frequency divider 104, and the clock circuit 105 form a clock unit.

The clock generation circuit 106 outputs a clock of prescribed frequency on the basis of a ticking timing of the clock unit. In the present embodiment, the clock generation circuit 106 divides the signal output by the clock circuit 105 in order to generate an 8 Hz clock, for example. Moreover, the clock generation circuit 106 outputs the generated clock to the display module 30.

The ROM 20 is a mask ROM or rewritable non-volatile memory or the like and stores control programs and initial settings data. These control programs include a program 21 related to control of various processes that will be described later.

Figure 2:
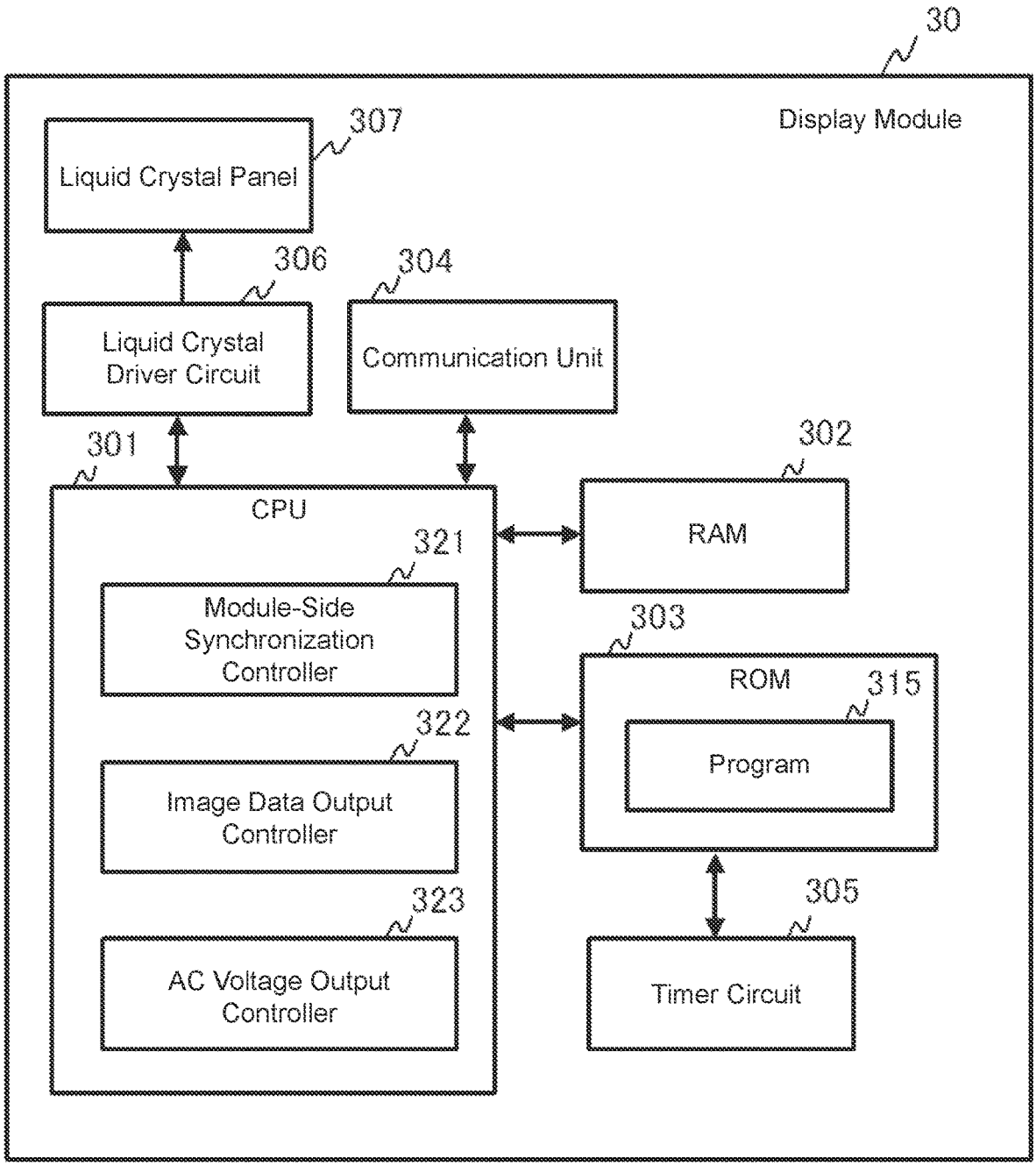
FIG. 2 illustrates an example of the configuration of a display module according to the embodiment.

The display module 30 is a module for displaying image data in accordance with instructions from the CPU 101. FIG. 2 is a block diagram illustrating an example of the configuration of the display module 30. As illustrated in FIG. 2, the display module 30 includes a CPU 301 (a second CPU), a RAM 302, a ROM 303, a communication unit 304, a liquid crystal driver circuit 306, and a liquid crystal panel 307.

The CPU 301 is a processor which performs various types of calculation processes and is responsible for controlling the overall operation of the display module 30. The CPU 301 reads control programs from the ROM 303 and loads these programs into the RAM 302 to execute various types of operation processes such as calculation control processes and display processes related to various features.

The RAM 302 is volatile memory such as SRAM or DRAM and provides a working memory space that the CPU 301 can use to transitorily store data and various types of configuration data.

The ROM 303 is a mask ROM or rewritable non-volatile memory or the like and stores control programs and initial settings data. These control programs include a program 315 related to various processes that will be described later.

The communication unit 304 includes a communication interface for communicating with the microcomputer 10 and the like.

The timer circuit 305 takes the clock output by the clock generation circuit 106 and counts to a prescribed number of pulses corresponding to the prescribed frequency of that clock. In the present embodiment, when the clock generation circuit 106 is outputting an 8 Hz clock, upon counting eight pulses in the clock, the timer circuit 305 outputs an interrupt signal to the CPU 301 indicating that it is time to invert the polarity of VCOM (described later). In other words, the interrupt signal is output from the timer circuit 305 at interrupt intervals of every one second. Upon receiving this interrupt signal, the CPU 301 instructs the liquid crystal driver circuit 306 to invert the polarity of VCOM.

Figure 3:
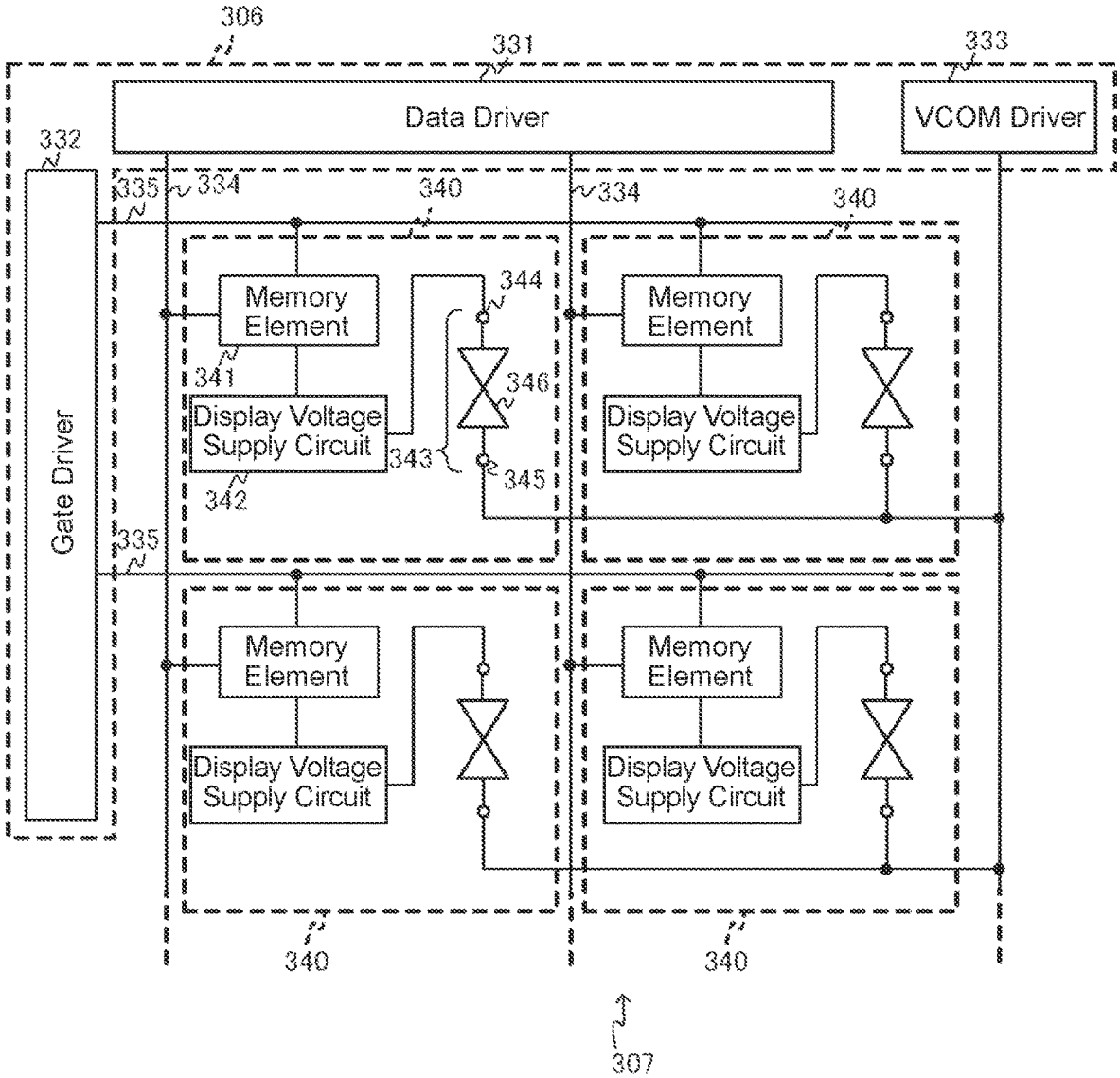
FIG. 3 is an example of a circuit diagram illustrating the configuration of a liquid crystal driver circuit and a liquid crystal panel according to the embodiment.

The liquid crystal driver circuit 306, in accordance with control signals from the CPU 301, outputs a drive signal for driving the liquid crystal panel 307 to the liquid crystal panel 307 in order to make the liquid crystal panel 307 display the time and various other features. More specifically, as illustrated in FIG. 3, the liquid crystal driver circuit 306 includes a data driver 331, a gate driver 332, and a VCOM driver 333. The data driver 331 outputs data signals to data bus lines 334 in accordance with control signals and a clock signal from the CPU 301. The gate driver 332 outputs scanning signals to gate bus lines 335 in accordance with control signals and the clock signal from the CPU 301. The VCOM driver 333, in accordance with control signals from the CPU 301, outputs an AC voltage (VCOM) to be applied to display elements 343 (described later). Moreover, the polarity of VCOM is inverted in accordance with instructions from the CPU 301.

The liquid crystal panel 307 performs a digital display operation for displaying the time and data related to various other features. In the present embodiment, the liquid crystal panel 307 is a memory-in-pixel (MIP) liquid crystal panel in which each of a plurality of pixels arranged in a matrix pattern includes a memory element that stores data corresponding to that pixel.

FIG. 3 schematically illustrates a circuit including the liquid crystal driver circuit 306 and the liquid crystal panel 307 according to the present embodiment. As illustrated in FIG. 3, each of a plurality of pixels 340 included in the liquid crystal panel 307 includes a memory element 341, a display voltage supply circuit 342, and a display element 343. Moreover, each display element 343 includes a pixel electrode 344, a common electrode 345, and liquid crystal 346. To make the pixels 340 display an image, the gate driver 332 outputs scanning signals to the gate bus lines 335 on which the target pixels 340 are arranged, and the data driver 331 outputs data signals. These data signals are stored in the memory elements 341 included in the respective pixels 340. Next, each display voltage supply circuit 342 supplies a voltage corresponding to the data stored in the respective memory element 341 to the respective pixel electrode 344. Thus, the voltages between the respective pixel electrodes 344 and common electrodes 345 (to which an AC voltage is supplied by the VCOM driver 333) cause an image to be displayed. If there is no need to rewrite the displayed image, the display voltage supply circuits 342 continue to supply a voltage to the respective pixel electrodes 344, and operation of the data driver 331 and the gate driver 332 is suspended. When the displayed image does need to be rewritten, the data driver 331 and the gate driver 332 resume an active state and update the data stored in the memory elements 341. This type of operation eliminates the need for frequent rewrites and thereby makes it possible to reduce power consumption in comparison with a conventional thin-film transistor (TFT) liquid crystal display.

Returning to FIG. 1, the oscillator 40 is a crystal oscillator, for example, and is integrated into the oscillator circuit 103 for the purpose of generating a signal of prescribed frequency.

The operation receiving unit 50 receives input operations from a user and outputs electrical signals corresponding to these input operations to the microcomputer 10 as input signals. The operation receiving unit 50 includes push-button switches or a crown, for example. Alternatively, a touch sensor serving as the operation receiving unit 50 may be arranged overlapping with the display screen of the liquid crystal panel 307, thereby allowing the display screen to also function as a touch panel. In this case, as a user performs touch operations on the touch sensor, the touch sensor detects the touch position and type of touch operation and outputs operation signals corresponding to the detected touch position and type of touch operation to the CPU 101.

The communication unit 60 includes a radio frequency (RF) circuit, baseband (BB) circuit, and a memory circuit, for example. Here, the communication unit 60 sends and receives wireless signals based on the Bluetooth Low Energy (BLE) standard, for example. Moreover, the communication unit 60 performs demodulation, decoding, or the like on the received wireless signals, and then sends them to the CPU 101. Furthermore, the communication unit 60 performs encoding, modulation, or the like on signals sent from the CPU 101, and then transmits them externally.

The GPS receiver 70 is a module which receives transmitted radio waves from Global Positioning System (GPS) satellites via an antenna and then processes these radio waves to obtain date and time information and positional information. In the present embodiment, once the GPS receiver obtains this date and time information, the CPU 101 corrects the time kept by the clock circuit 105 on the basis of the time included in this date and time information, for example.

The power supply 80 includes a battery and a voltage conversion circuit, for example. The power supply 80 supplies power at the operating voltages of the components in the electronic timepiece 1. In the present embodiment, a primary battery such as a button cell is used as the battery of the power supply 80. Alternatively, a solar panel and secondary battery may be used as the battery of the power supply 80.

Next, the functional configuration of the CPU 101 in the microcomputer 10 of the electronic timepiece 1 according to the present embodiment will be described. As illustrated in FIG. 1, the CPU 101 functions as a host-side synchronization controller 121 and a display controller 122. The functions of the host-side synchronization controller 121 and the display controller 122 may both be implemented by the single CPU 101 or may be respectively implemented by separate CPUs. Alternatively, these functions may be implemented by a processor other than the CPU 101, such as the CPU of the communication unit 60 (not illustrated in the figure).

When functioning as the host-side synchronization controller 121, the CPU 101 performs a control process to synchronize the ticking timing of the clock unit and a count-up timing of the timer circuit 305. More specifically, when the ticking timing of the clock unit changes, the CPU 101 outputs a synchronization request signal at the next ticking timing after the change to request resynchronization with the CPU 301.

Even more specifically, when a synchronization request signal output flag is ON when the clock circuit 105 counts a second, the CPU 101 executes a synchronization starting point output process to output a synchronization request signal to the CPU 301. Here, the synchronization request signal output flag is a flag indicating whether a synchronization request signal should be sent to the CPU 301, where a state of ON indicates that a synchronization request signal should be sent and a state of OFF indicates that no synchronization request signal should be sent. When the seconds of the time kept by the clock circuit 105 are adjusted on the basis of time information received from an external device connected via a wireless communication scheme such as BLE, from GPS satellites, or from a standard radio wave transmitting station, for example, the CPU 101 determines that the ticking timing of the clock circuit 105 and the count-up timing of the timer circuit 305 need to be resynchronized and sets the synchronization request signal output flag to ON.

Moreover, in the synchronization starting point output process, the CPU 101 outputs a control signal which takes an ON state for a prescribed period of time (such as 30 msec) as the synchronization request signal, and this signal is output to a dedicated synchronization terminal connected to the CPU 301, for example. Then, upon receiving a module-side synchronization state signal indicating that synchronization is complete from the CPU 301, the CPU 101 sets a host-side synchronization state flag to ON and outputs a host-side synchronization state signal indicating that synchronization is complete to the CPU 301. Here, the host-side synchronization state flag is a flag indicating whether the ticking timing of the clock unit and the count-up timing of the timer circuit 305 are synchronized, where a state of ON indicates that these timings are synchronized and a state of OFF indicates that these timings are not synchronized. When the ticking timing changes due to the seconds of the time kept by the clock circuit 105 being adjusted, for example, the CPU 101 sets the host-side synchronization state flag to OFF. Moreover, the host-side synchronization state flag and the synchronization request signal output flag are stored in the RAM 102, for example.

The CPU 101 also performs a host-side synchronization state checking process to check the synchronization state. More specifically, when the host-side synchronization state flag is ON and the module-side synchronization state signal output by the CPU 301 indicates that synchronization has been lost, the CPU 101 sets the host-side synchronization state flag to OFF. In this way, the CPU 101 matches the synchronization state to that of the CPU 301.

When functioning as the display controller 122, the CPU 101 generates image data to be displayed on the liquid crystal panel 307 of the display module 30. For example, the CPU 101 generates image data representing the current time to be displayed each time a second is counted and outputs this image data to the display module 30.

Next, the functional configuration of the CPU 301 in the display module 30 of the electronic timepiece 1 according to the present embodiment will be described. As illustrated in FIG. 2, the CPU 301 functions as a module-side synchronization controller 321, an image data output controller 322, and an AC voltage output controller 323. The functions of the module-side synchronization controller 321, the image data output controller 322, and the AC voltage output controller 323 may all be implemented by the single CPU 301 or may be respectively implemented by separate CPUs. Alternatively, these functions may be implemented by a processor other than the CPU 301.

When functioning as the module-side synchronization controller 321, the CPU 301 performs a control process to synchronize the ticking timing of the clock unit and the count-up timing of the timer circuit 305. More specifically, upon receiving a synchronization request signal from the CPU 101, the CPU 301 sets the timer circuit 305 to start a new count of the clock. Even more specifically, upon receiving the synchronization request signal from the CPU 101, the CPU 301 sets a module-side synchronization state flag to ON and sets the timer circuit 305 to start a new count of the clock. Here, the module-side synchronization state flag is a flag indicating whether the ticking timing of the clock unit and the count-up timing of the timer circuit 305 are synchronized, where a state of ON indicates that these timings are synchronized and a state of OFF indicates that these timings are not synchronized. This module-side synchronization state flag is stored in the RAM 302, for example. Moreover, after setting the module-side synchronization state flag to ON, the CPU 301 outputs a module-side synchronization state signal indicating that synchronization is complete to the CPU 101. Then, upon receiving a host-side synchronization state signal indicating that synchronization is complete from the CPU 101, the CPU 301 determines that the ticking timing of the clock unit and the count-up timing of the timer circuit 305 are synchronized on both the CPU 101 and the CPU 301 and proceeds to instruct the liquid crystal driver circuit 306 to invert the polarity of VCOM.

The CPU 301 also performs a module-side synchronization state checking process to check the synchronization state. More specifically, when the module-side synchronization state flag is ON and the host-side synchronization state signal output by the CPU 101 indicates that synchronization has been lost, the CPU 301 sets the module-side synchronization state flag to OFF. In this way, the CPU 301 matches the synchronization state to that of the CPU 101.

When functioning as the image data output controller 322, the CPU 301 instructs the liquid crystal driver circuit 306 to output image data to the plurality of pixels 340. For example, the CPU 301 receives image data that should be output from the CPU 101, stores this data in the RAM 302, and then sets an image data output flag to ON. Here, the image data output flag is a flag indicating whether image data is currently being output to the pixels 340, where a state of ON indicates that image data is currently being output to the pixels 340 and a state of OFF indicates that image data is not currently being output to the pixels 340. After setting the image data output flag to ON, the CPU 301 instructs the liquid crystal driver circuit 306 to output the image data stored in the RAM 302 to the pixels 340. Moreover, when output of the image data to the pixels 340 is complete, the CPU 301 sets the image data output flag to OFF. The image data output flag is stored in the RAM 302, for example. In the following description, the period of time from when output of image data to the pixels 340 starts until when output of the image data finishes will be referred to as the "image data output period".

When functioning as the AC voltage output controller 323, the CPU 301 instructs the liquid crystal driver circuit 306 to, at the interrupt intervals (prescribed intervals), invert the polarity of VCOM and output the resulting voltage VCOM to be applied to the liquid crystal panel 307. More specifically, each time the timer circuit 305 counts eight pulses in the clock output by the clock generation circuit 106, the timer circuit 305 outputs an interrupt signal. Upon receiving the interrupt signal, the CPU 301 determines that it is time to invert the polarity of VCOM. Moreover, if this timing at which the polarity of VCOM should be inverted is within the image data output period, the timing is changed to a timing that will occur after the image data output period. For example, if the image data output flag is ON when the interrupt signal is received, the CPU 301 sets a polarity unchanged flag to ON and makes the liquid crystal driver circuit 306 continue to output VCOM at the current polarity. Here, the polarity unchanged flag is a flag indicating whether the polarity of VCOM was inverted at the timing at which the polarity of VCOM should have been inverted, where a state of ON indicates that VCOM was not inverted and a state of OFF indicates that VCOM was inverted. Moreover, if the polarity unchanged flag is ON after the image data output period is complete, the CPU 301 instructs the liquid crystal driver circuit 306 to invert the polarity of VCOM and output the resulting voltage VCOM. Meanwhile, if the image data output flag is OFF when the interrupt signal is received, the CPU 301 instructs the liquid crystal driver circuit 306 to invert the polarity of VCOM and output the resulting voltage VCOM. The polarity unchanged flag is stored in the RAM 302, for example.

Figure 4:
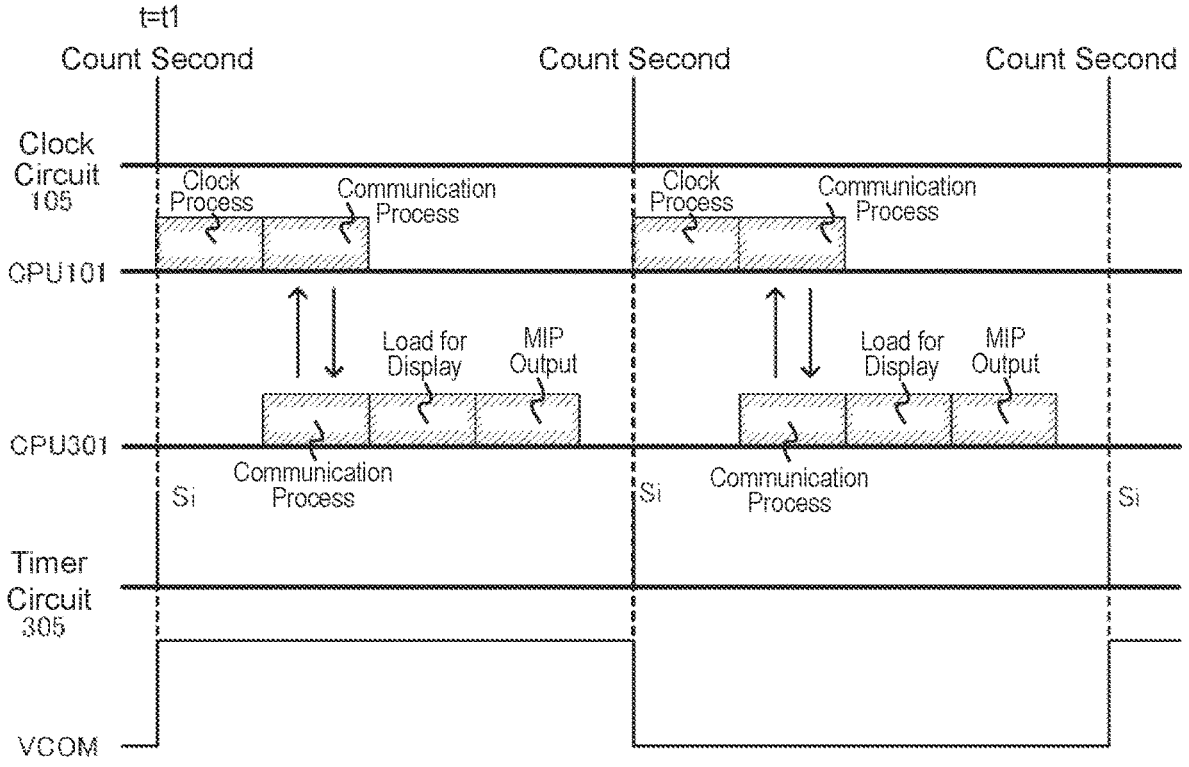
FIG. 4 is an example of a timing chart illustrating processes performed by a microcomputer and the display module as well as how a voltage VCOM is inverted during normal operation.

FIG. 4 is an example of a timing chart illustrating processes performed by the microcomputer 10 and the display module 30 as well as how VCOM is inverted during normal operation. During normal operation, the timing at which the clock circuit 105 counts seconds is synchronized with the timing at which the timer circuit 305 reaches a count of eight pulses; in other words, VCOM is inverted each time a second is counted. As illustrated in FIG. 4, when the clock circuit 105 counts a second at time t=t1, the CPU 101 executes a clock process to calculate the current time and generate image data representing the current time. Meanwhile, upon receiving an interrupt signal Si from the timer circuit 305 at time t=t1 and then determining that t1 is not within the image data output period, the CPU 301 of the display module 30 inverts VCOM. Then, after the clock process is complete, the CPU 101 executes a communication process to output the generated image data to the CPU 301 of the display module 30. The CPU 301 receives the image data from this communication process, loads the image data for display, and outputs the resulting image data to the liquid crystal panel 307 (MIP). During normal operation, the CPUs 101 and 301 execute the processes described above each time the clock circuit 105 counts a second.

Figure 5:
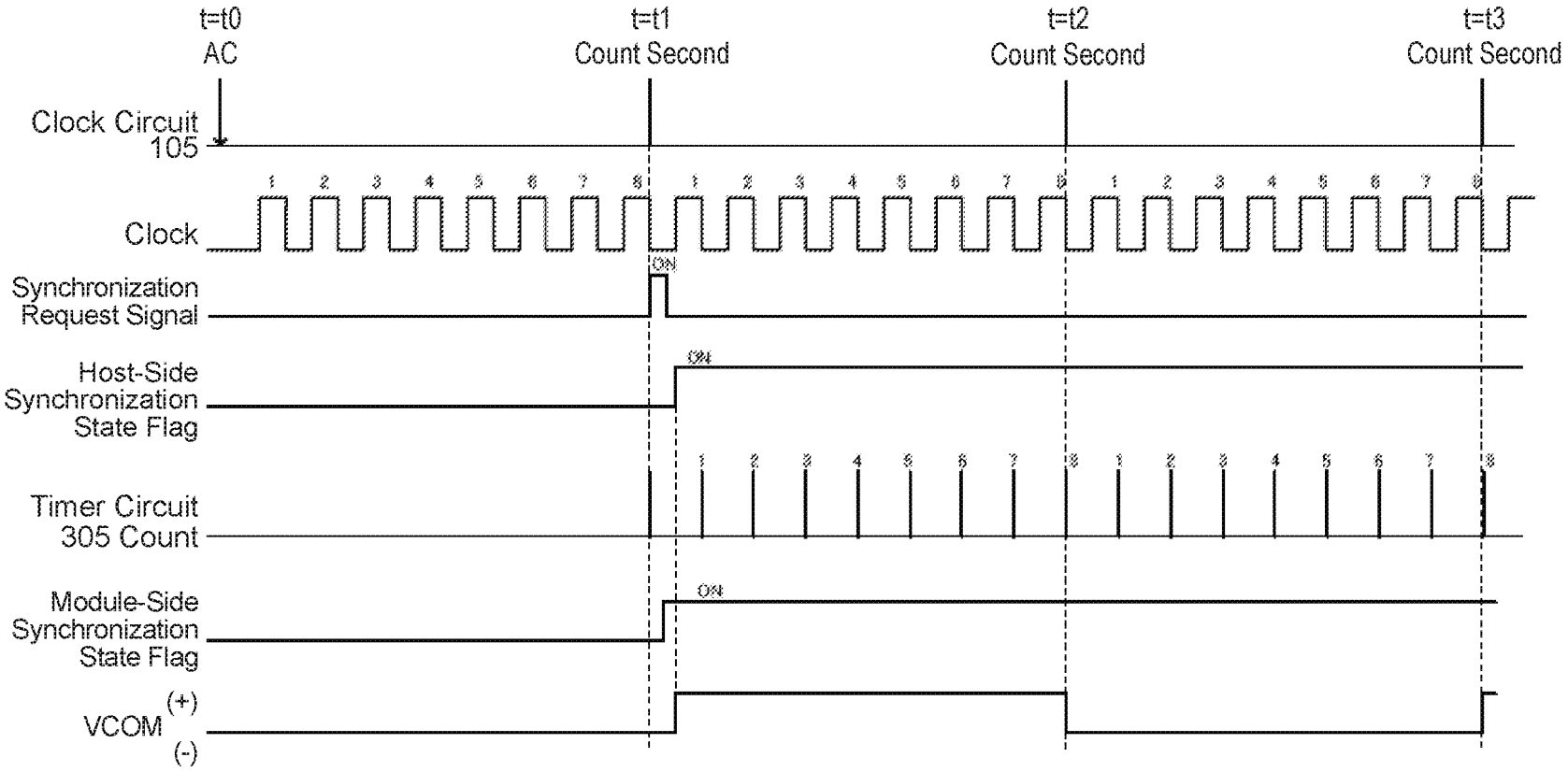
FIG. 5 is an example of a timing chart illustrating a synchronization process performed between the microcomputer and the display module after an all-clear event.

FIG. 5 is an example of a timing chart illustrating a synchronization process performed between the microcomputer 10 and the display module 30 after an all-clear event. As illustrated in FIG. 5, when settings are initialized at time t=t0 (all-clear; AC), the clock generation circuit 106 begins to output an 8 Hz clock that has been generated. Then, at time t=t1 (that is, on the eighth pulse of the clock), the clock circuit 105 counts a second. At this time, the module-side synchronization state flag and the host-side synchronization state flag are OFF, and therefore the CPU 101 outputs an ON signal of prescribed duration to the dedicated synchronization terminal as a synchronization request signal. Moreover, the timer circuit 305 starts counting pulses in the clock generated by the clock generation circuit 106. Next, the CPU 301 receives the synchronization request signal and sets the module-side synchronization state flag to ON. Then, once the module-side synchronization state flag has been set to ON, the CPU 101 sets the host-side synchronization state flag to ON. Next, once the host-side synchronization state flag has been set to ON, the CPU 301 inverts the polarity of VCOM. Then, each time the timer circuit 305 subsequently reaches a count of eight, the CPU 301 inverts the polarity of VCOM.

Figure 6:
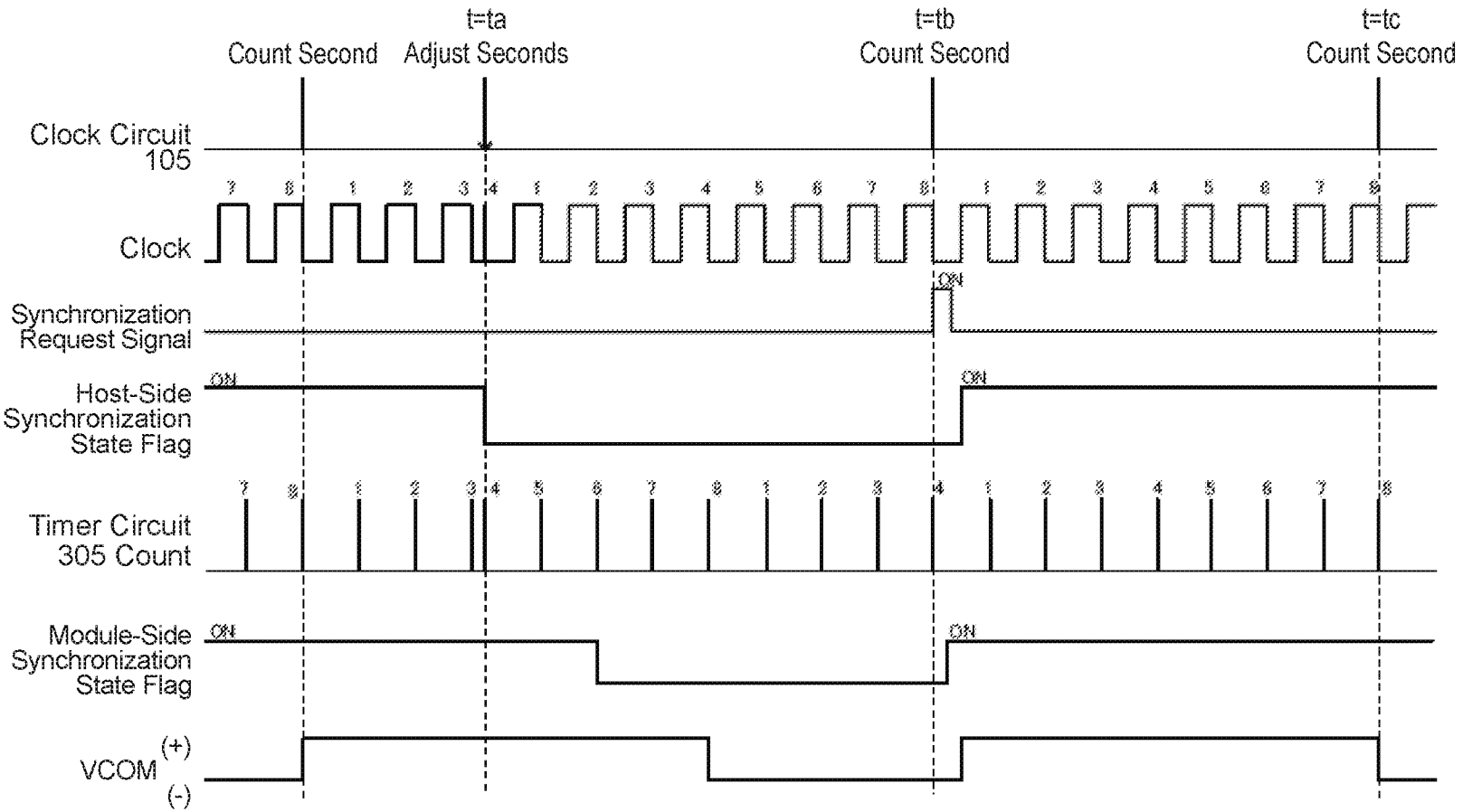
FIG. 6 is an example of a timing chart illustrating a synchronization process performed between the microcomputer and the display module when seconds are adjusted.

FIG. 6 is an example of a timing chart illustrating a synchronization process performed between the microcomputer 10 and the display module 30 when the seconds are adjusted. As illustrated in FIG. 6, starting from a state in which the host-side synchronization state flag and the module-side synchronization state flag are both in the ON state, when the seconds are then adjusted at time t=ta, thereby causing the timing of the clock generated by the clock generation circuit 106 to be adjusted, the CPU 101 sets the host-side synchronization state flag to OFF. Moreover, upon detecting at a prescribed timing that the host-side synchronization state flag has been set to OFF, the CPU 301 sets the module-side synchronization state flag to OFF. Next, at time t=tb, at which the host-side synchronization state flag and the module-side synchronization state flag are both OFF, the CPU 101 outputs an ON signal of prescribed duration to the dedicated synchronization terminal as a synchronization request signal. The CPU 301 then receives this synchronization request signal and sets the module-side synchronization state flag to ON. Moreover, the CPU 301 sets the timer circuit 305 to start a new count. Then, once the module-side synchronization state flag has been set to ON, the CPU 101 sets the host-side synchronization state flag to ON. Next, once the host-side synchronization state flag has been set to ON, the CPU 301 inverts the polarity of VCOM. Then, similar to in the flowchart illustrated in FIG. 5, each time the timer circuit 305 subsequently reaches a count of eight, the CPU 301 inverts the polarity of VCOM.

Figure 7:
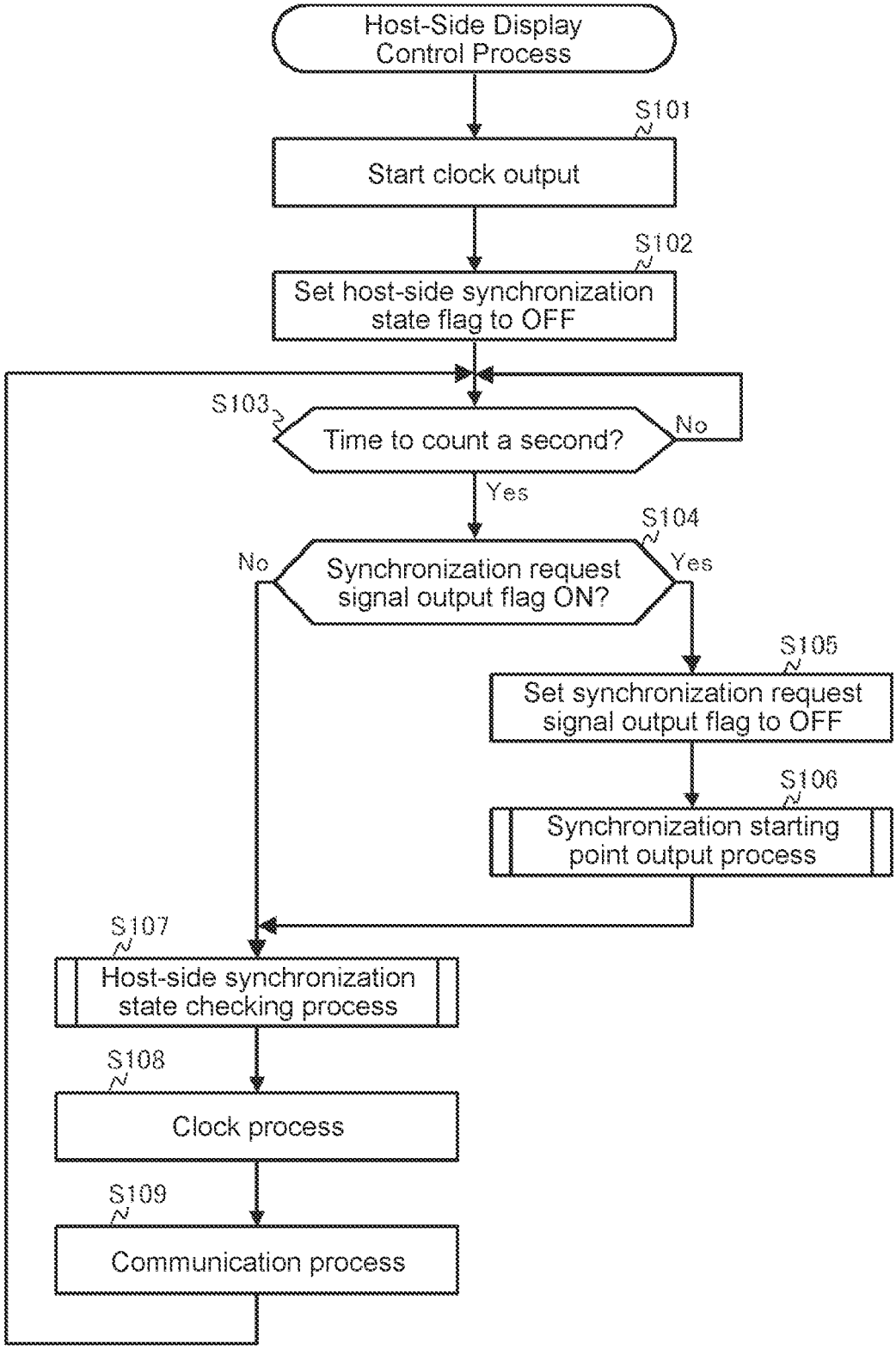
FIG. 7 is a flowchart illustrating a control procedure for a host-side display control process executed by a CPU of the microcomputer.

FIG. 7 is a flowchart illustrating a control procedure for a host-side display control process executed by the CPU 101 in the microcomputer 10 of the electronic timepiece 1. Upon receiving an instruction to start this process via the operation receiving unit 50, for example, the CPU 101 clears all the parameters and then executes the following processes.

First, the CPU 101 makes the clock generation circuit 106 start outputting a clock (step S101). Next, the CPU 101 sets the host-side synchronization state flag to OFF (step S102).

Then, the CPU 101 determines, on the basis of the output signal from the clock circuit 105, whether it is time to count a second (step S103). Here, the CPU 101 stands by until having determined that it is time to count a second (No in step S103).

Upon determining that it is time to count a second (Yes in step S103), the CPU 101 then determines whether the synchronization request signal output flag is ON (step S104). Upon determining that the synchronization request signal output flag is ON (Yes in step S104), the CPU 101 sets the synchronization request signal output flag to OFF (step S105) and then executes the synchronization starting point output process (step S106; described later).

Meanwhile, upon determining that the synchronization request signal output flag is OFF (No in step S104), or after executing the synchronization starting point output process (step S106), the CPU 101 executes the host-side synchronization state checking process (step S107; described later).

Next, the CPU 101 executes the clock process (step S108) and, after executing a communication process with the CPU 301 (step S109), returns to step S103 and repeatedly executes the processes of steps S103 to S109.

Figure 8:
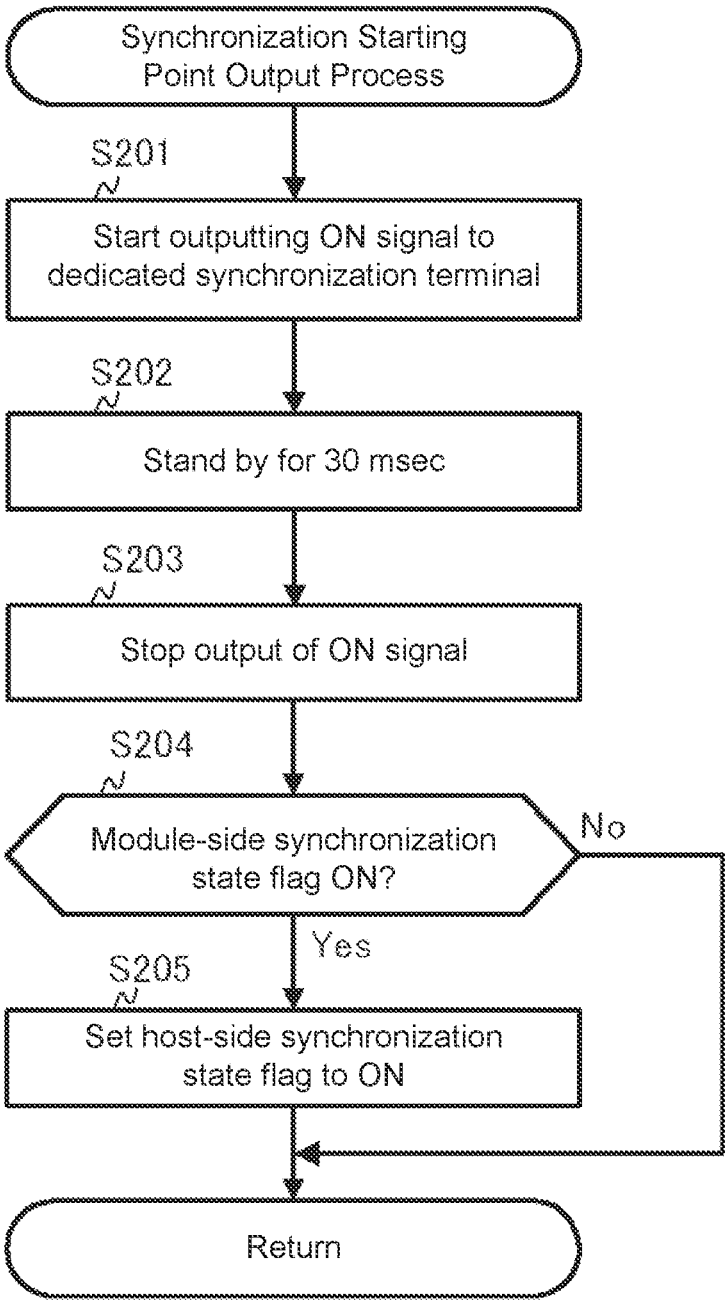
FIG. 8 is a flowchart illustrating a control procedure for a synchronization starting point output process executed by the CPU of the microcomputer.

Next, the synchronization starting point output process of step S106 in FIG. 7 will be described. FIG. 8 is a flowchart illustrating a control procedure for the synchronization starting point output process executed by the CPU 101 in the microcomputer 10 of the electronic timepiece 1.

First, the CPU 101 starts outputting an ON signal to the dedicated synchronization terminal as a synchronization request signal (step S201). Next, the CPU 101 stands by for 30 msec (step S202) and then stops output of the ON signal to the dedicated synchronization terminal (step S203).

Then, the CPU 101 determines whether the module-side synchronization state flag is ON (step S204). Upon determining that the module-side synchronization state flag is ON (Yes in step S204), the CPU 101 sets the host-side synchronization state flag to ON (step S205). Meanwhile, upon determining that the module-side synchronization state flag is OFF (No in step S204), or after setting the host-side synchronization state flag to ON (step S205), the CPU 101 returns to the host-side display control process of FIG. 7 and proceeds to step S107 therein.

Figure 9:
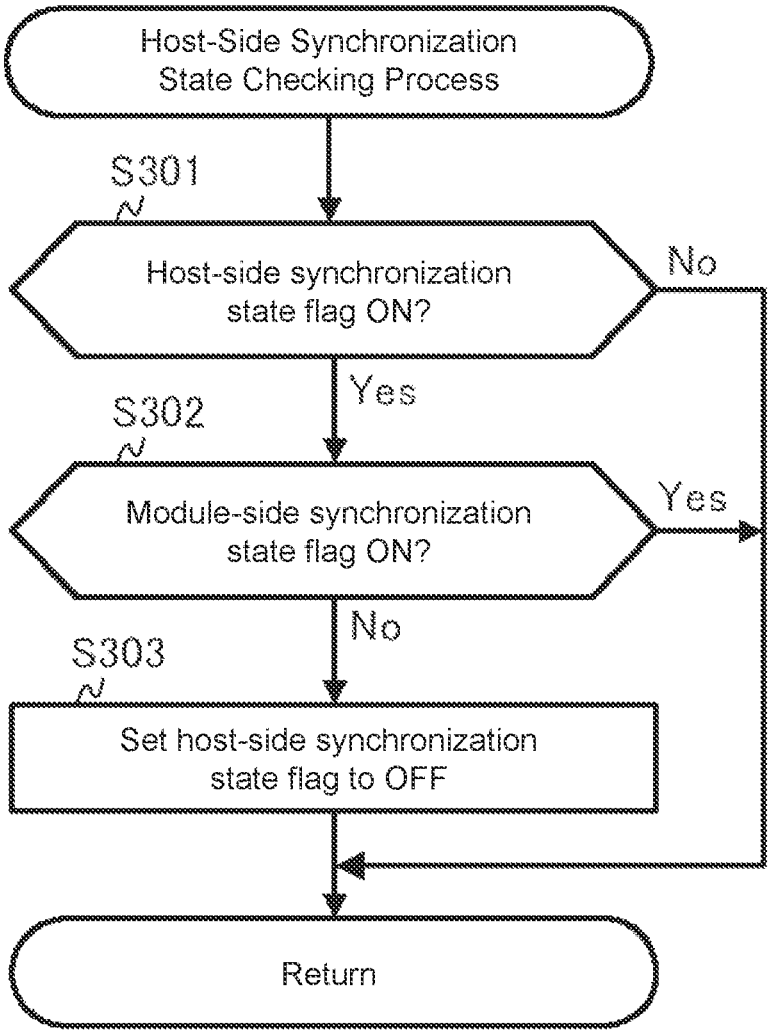
FIG. 9 is a flowchart illustrating a control procedure for a host-side synchronization state checking process executed by the CPU of the microcomputer.

Next, the host-side synchronization state checking process of step S107 in FIG. 7 will be described. FIG. 9 is a flowchart illustrating a control procedure for the host-side synchronization state checking process executed by the CPU 101 in the microcomputer 10 of the electronic timepiece 1.

First, the CPU 101 determines whether the host-side synchronization state flag is ON (step S301). Upon determining that the host-side synchronization state flag is ON (Yes in step S301), the CPU 101 then determines whether the module-side synchronization state flag is ON (step S302). Upon determining that the module-side synchronization state flag is OFF (No in step S302), the CPU 101 sets the host-side synchronization state flag to OFF (step S303). Meanwhile, upon determining that the host-side synchronization state flag is OFF (No in step S301), determining that the module-side synchronization state flag is ON (Yes in step S302), or after setting the host-side synchronization state flag to OFF (step S303), the CPU 101 returns to the host-side display control process of FIG. 7 and proceeds to step S108 therein.

Figure 10:
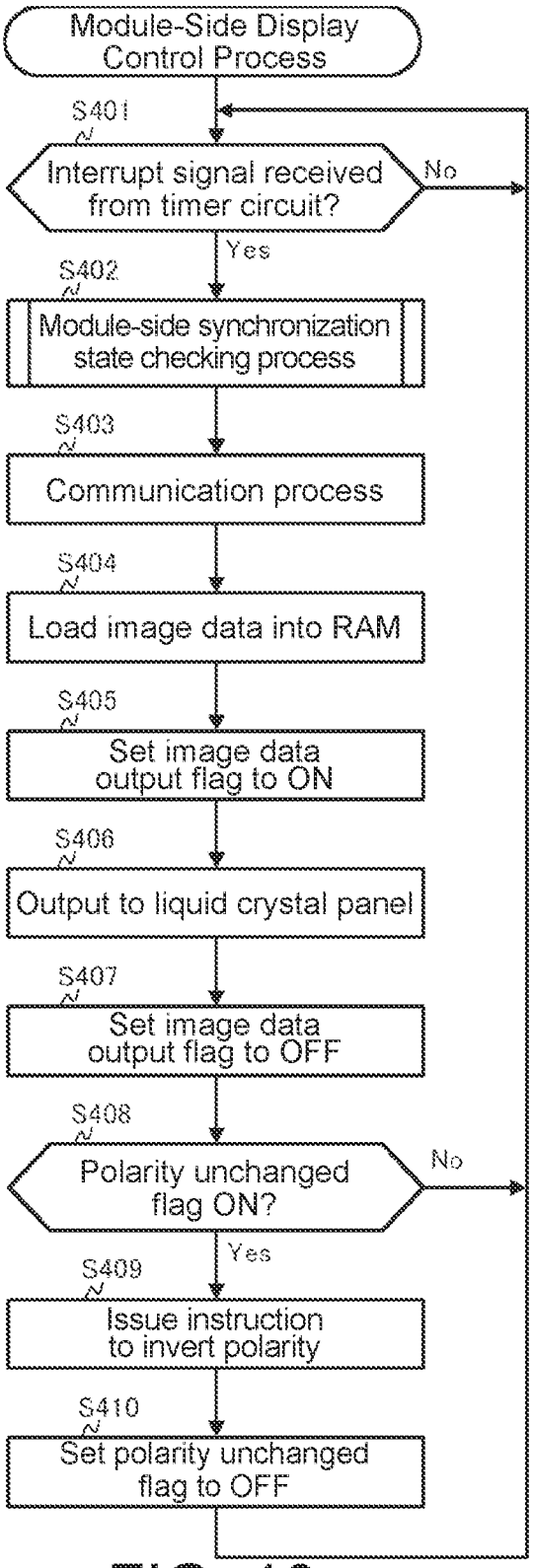
FIG. 10 is a flowchart illustrating a control procedure for a module-side display control process executed by a CPU of the display module.

FIG. 10 is a flowchart illustrating a control procedure for a module-side display control process executed by the CPU 301 in the display module 30 of the electronic timepiece 1. Upon receiving an instruction to start this process via the operation receiving unit 50, for example, the CPU 301 initializes settings and then executes the following process.

First, the CPU 301 determines whether an interrupt signal has been received from the timer circuit 305 (step S401). Here, the CPU 301 stands by until having determined that an interrupt signal has been received from the timer circuit 305 (No in step S401).

Upon determining that an interrupt signal has been received (Yes in step S401), the CPU 301 executes the module-side synchronization state checking process (step S402; described later).

Next, the CPU 301 executes a communication process with the CPU 101 (step S403) and then loads the received image data into the RAM 302 (step S404).

Then, the CPU 301 sets the image data output flag to ON (step S405). Next, the CPU 301 outputs the image data loaded into the RAM 302 in step S404 to the liquid crystal panel 307 (step S406). Then, once output of the image data is complete, the CPU 301 sets the image data output flag to OFF (step S407).

Next, the CPU 301 determines whether the polarity unchanged flag is ON (step 408). Upon determining that the polarity unchanged flag is OFF (No in step S408), the CPU 301 returns to the process of step S401.

Meanwhile, upon determining that the polarity unchanged flag is ON (Yes in step S408), the CPU 301 instructs the liquid crystal driver circuit 306 to invert the polarity of the AC voltage (step S409). Then, the CPU 301 sets the polarity unchanged flag to OFF (step S410) and returns to the process of step S401.

Figure 11:
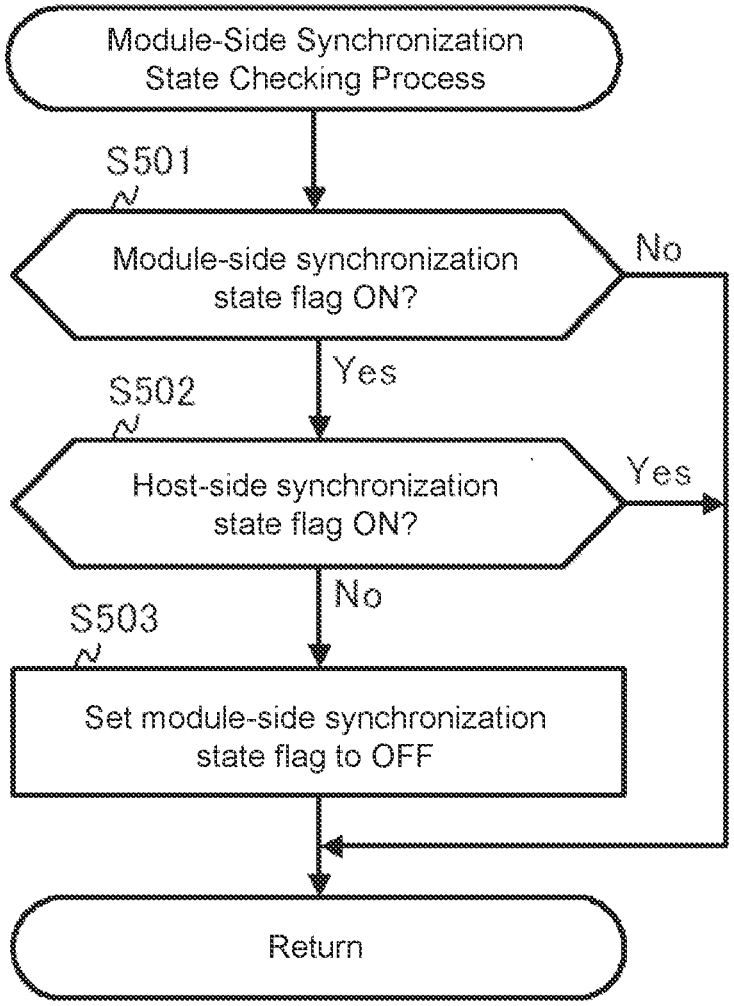
FIG. 11 is a flowchart illustrating a control procedure for a module-side synchronization state checking process executed by the CPU of the display module.

Next, the module-side synchronization state checking process of step S402 in FIG. 10 will be described. FIG. 11 is a flowchart illustrating a control procedure for the module-side synchronization state checking process executed by the CPU 301 in the display module 30 of the electronic timepiece 1.

First, the CPU 301 determines whether the module-side synchronization state flag is ON (step S501). Upon determining that the module-side synchronization state flag is ON (Yes in step S501), the CPU 301 then determines whether the host-side synchronization state flag is ON (step S502). Upon determining that the host-side synchronization state flag is OFF (No in step S502), the CPU 301 sets the module-side synchronization state flag to OFF (step S503). Meanwhile, upon determining that the module-side synchronization state flag is OFF (No in step S501), determining that the host-side synchronization state flag is ON (Yes in step S502), or after setting the module-side synchronization state flag to OFF (step S503), the CPU 301 returns to the module-side display control process of FIG. 10 and proceeds to step S403 therein.

Figure 12:
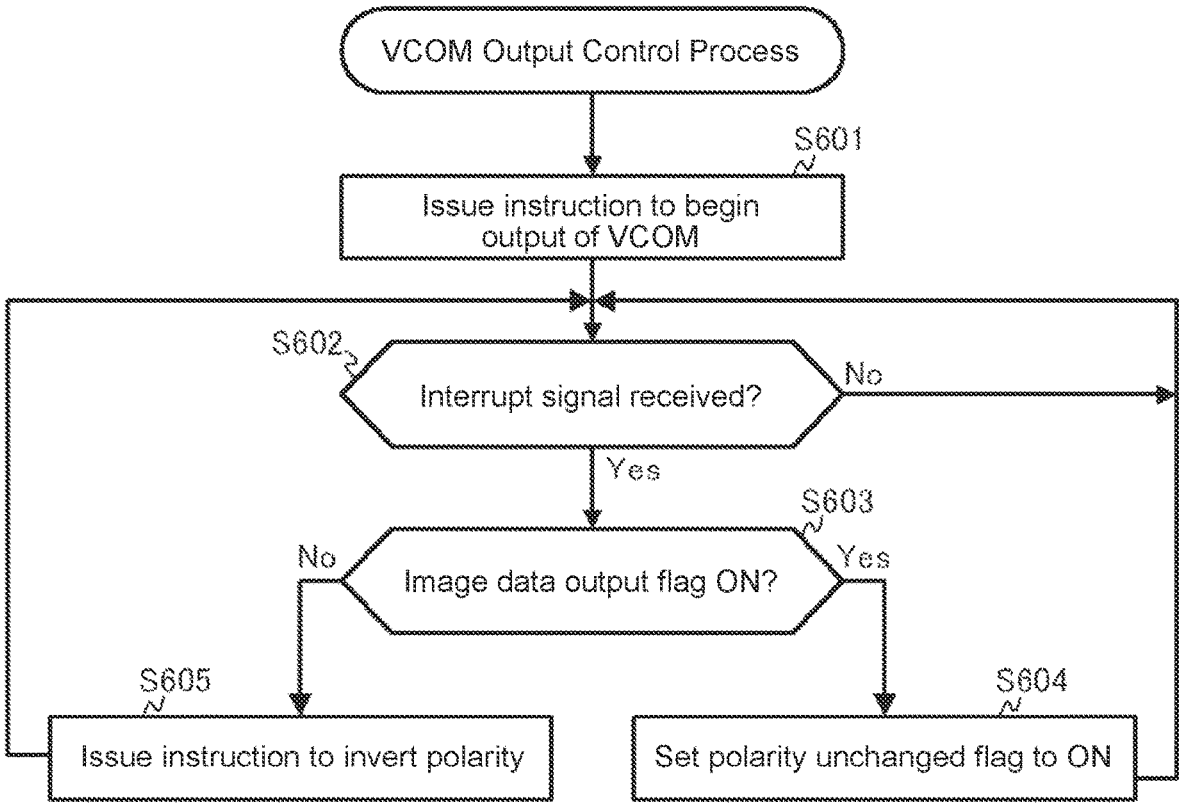
FIG. 12 is a flowchart illustrating a control procedure for a VCOM output control process executed by the CPU of the display module.

Next, a VCOM output control process will be described. FIG. 12 is a flowchart illustrating a control procedure for the VCOM output control process, which is executed by the CPU 301 in the display module 30 of the electronic timepiece 1. The CPU 301 starts the VCOM output control process upon receiving an instruction to start this process from the operation receiving unit 50, for example.

First, the CPU 301 instructs the liquid crystal driver circuit 306 to start outputting a voltage VCOM having an initial polarity (step S601).

Next, the CPU 301 determines whether an interrupt signal has been received from the timer circuit 305 (step S602). Here, the CPU 301 stands by until receipt of an interrupt signal (No in step S602).

Upon determining that an interrupt signal has been received (Yes in step S602), the CPU 301 then determines whether the image data output flag is ON (step S603).

Upon determining that the image data output flag is ON (Yes in step S603), the CPU 301 sets the polarity unchanged flag to ON (step S604). Then, the CPU 301 returns to the process of step S602.

Meanwhile, upon determining that the image data output flag is OFF (No in step S603), the CPU 301 instructs the liquid crystal driver circuit 306 to invert the polarity of VCOM (step S605). Then, the CPU 301 returns to the process of step S602.

Figure 13:
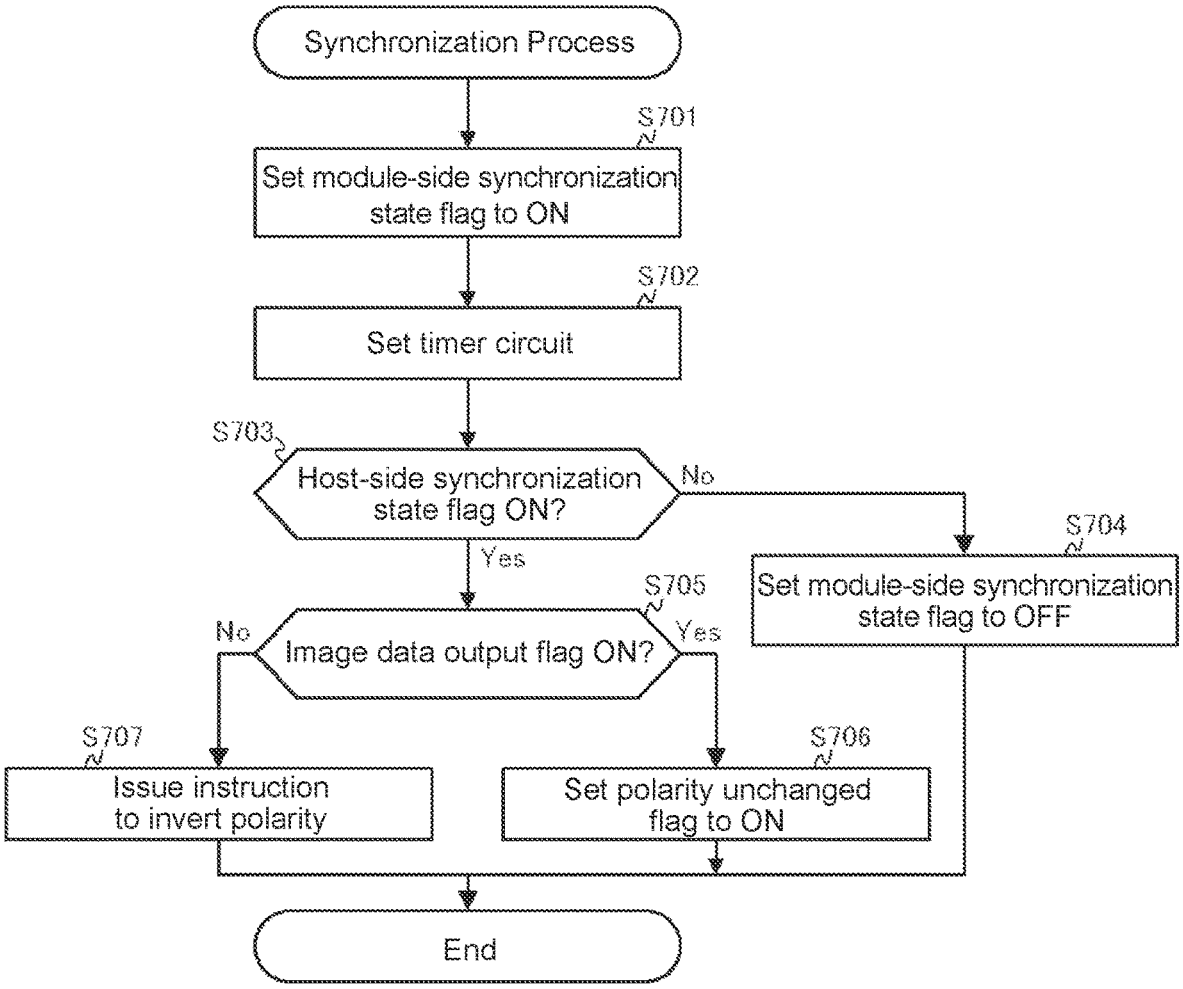
FIG. 13 is a flowchart illustrating a control procedure for a synchronization process executed by the CPU of the display module.

FIG. 13 is a flowchart illustrating a control procedure for a synchronization process executed by the CPU 301 in the display module 30 of the electronic timepiece 1. The CPU 301 starts this synchronization process upon receiving a synchronization request signal.

First, the CPU 301 sets the module-side synchronization state flag to ON (step S701). Next, the CPU 301 sets the timer circuit 305 to start a new count of the clock (step S702).

Then, the CPU 301 determines whether the host-side synchronization state flag is ON (step S703). Upon determining that the host-side synchronization state flag is OFF (No in step S703), the CPU 301 sets the module-side synchronization state flag to OFF (step S704) and ends the process.

Meanwhile, upon determining that the host-side synchronization state flag is ON (Yes in step S703), the CPU 301 then determines whether the image data output flag is ON (step S705).

Upon determining that the image data output flag is ON (Yes in step S705), the CPU 301 sets the polarity unchanged flag to ON (step S706). The CPU 301 then ends the process.

Meanwhile, upon determining that the image data output flag is OFF (No in step S705), the CPU 301 instructs the liquid crystal driver circuit 306 to invert the polarity of VCOM (step S707). The CPU 301 then ends the process.

As described above, in the electronic timepiece 1 according to the present embodiment, when the ticking timing of the clock unit changes, the CPU 101 outputs a synchronization request signal at the next ticking timing after the change to request resynchronization with the CPU 301. Then, upon receiving this synchronization request signal from the CPU 101, the CPU 301 sets the timer circuit 305 to start a new count of the clock. Therefore, even when the time kept by the clock circuit 105 changes due to a time adjustment or the like, the count-up timing of the timer circuit 305 for controlling when VCOM is inverted is similarly adjusted so as to be synchronized with the ticking timing of the clock circuit 105. As a result, even if the timing of the image data output period changes due to a change in the ticking timing, the timing at which the polarity of VCOM is inverted is adjusted accordingly, and it is always possible to ensure that the timing at which the polarity of VCOM is inverted does not overlap with the image data output period. This makes it possible to prevent decreases in the reliability of the liquid crystal panel.

Moreover, in the electronic timepiece 1 according to the present embodiment, when the ticking timing of the clock unit changes and the host-side synchronization state flag indicates, at the next ticking timing after the change, that synchronization has been lost, the CPU 101 outputs a synchronization request signal to the CPU 301. Therefore, by referencing the host-side synchronization state flag, the CPU 101 can check the synchronization state and determine whether a synchronization request signal needs to be output.

Furthermore, in the electronic timepiece 1 according to the present embodiment, when the host-side synchronization state flag indicates that synchronization has been lost, the CPU 301 sets the module-side synchronization state flag to OFF. Then, upon receiving a synchronization request signal from the CPU 101, the CPU 301 sets the timer circuit to start a new count of the clock and also sets the module-side synchronization state flag to indicate that synchronization is complete. Moreover, once the module-side synchronization state flag indicates that synchronization is complete, the CPU 101 sets the host-side synchronization state flag to indicate that synchronization is complete. Then, once the host-side synchronization state signal indicates that synchronization is complete, the CPU 301 instructs the liquid crystal driver circuit 306 to invert the polarity of VCOM and output the resulting voltage VCOM. This makes it possible to confirm that the ticking timing of the clock unit and the count-up timing of the timer circuit 305 are synchronized on both the CPU 101 and the CPU 301 and thereafter invert the polarity of VCOM.

In addition, in the electronic timepiece 1 according to the present embodiment, if the timing at which the polarity of VCOM should be inverted is within the image data output period, the timing is changed to a timing that will occur after the image data output period. This makes it possible to prevent rewrite errors from occurring due to image data not being correctly stored in the memory elements 341 included in the pixels 340 as a result of the polarity of the AC voltage having been inverted during the image data output period. This, in turn, makes it possible to prevent decreases in the reliability of the liquid crystal panel 307.

The present invention is not limited to the embodiment described above, and various modifications are possible.

For example, in the embodiment above the liquid crystal driver circuit 306 was described as storing image data in the memory elements 341 respectively included in the plurality of pixels 340; in other words, the liquid crystal panel 307 was described as being an MIP liquid crystal panel as an example. However, the types of liquid crystal panels that can be used in the electronic timepiece of the present invention are not limited to this example. The liquid crystal panel 307 may be a TFT liquid crystal panel, for example. Note here that because an MIP liquid crystal panel has a lower image rewrite frequency than a TFT liquid crystal panel, if the timing at which the polarity of the AC voltage is inverted overlaps with the timing at which the image data is output and a rewrite error occurs, the resulting display state will persist for longer than in a TFT liquid crystal panel. Therefore, applying the electronic timepiece of the present invention to an MIP liquid crystal panel makes rewrite errors less likely to occur, thereby making it possible to improve the reliability of the MIP liquid crystal panel.

Moreover, in the description above the computer-readable media that store the programs 21 and 315 related to the various processes of the present invention were described as being the ROM 20 and 303, which are constituted by non-volatile memory such as flash memory, for example. However, the computer-readable media are not limited to this example and may be hard disk drives (HDDs) or portable storage media such as Compact Disc Read-Only Memory (CD-ROMs) or Digital Versatile Discs (DVDs). Moreover, carrier waves can be used in the present invention as a medium for providing the program data of the present invention over a communication route.

Furthermore, details such as the configurations, control procedures, and display examples of the embodiments described above can be modified as appropriate without departing from the spirit of the present invention.

Although several embodiments of the present invention were described above, the present invention is not limited to these embodiments and also includes any configurations encompassed within the scope of the claims and their equivalents. In particular, it is explicitly contemplated that any part or whole of any two or more of the embodiments and their modifications described above can be combined and regarded within the scope of the present invention.

What is claimed is:

1. An electronic timepiece, comprising:

a clock unit that keeps time, the clock unit repeatedly and periodically generating a ticking event at a prescribed ticking timing, the prescribed ticking timing being adjustable so as to correct the time kept by the clock unit;

a first processor that controls the clock unit;

a clock generation circuit that outputs a clock signal of a prescribed frequency in accordance with every ticking timing of the clock unit;

a timer circuit that repeatedly counts pulses in the clock signal output from the clock generation circuit up to a prescribed number of pulses that corresponds to the prescribed frequency;

a liquid crystal driver circuit that drives a liquid crystal panel; and a second processor that controls the timer circuit and the liquid crystal driver circuit, the second processor causing the liquid crystal driver circuit to invert a polarity of an AC voltage to be applied to the liquid crystal panel and apply the inverted AC voltages to the liquid crystal panel each time the timer circuit counts up the prescribed number of pulses in the clock signal, wherein when the ticking timing of the clock unit is adjusted and changed, the first processor outputs a synchronization request signal to the second processor at a next ticking timing of the clock unit that occurs after the change in the ticking timing, so as to request the second processor to perform resynchronization, and wherein upon receipt of the synchronization request signal from the first processor, the second processor resets the timer circuit so that the timer circuit starts a new count of pulses in the clock signal.

2. The electronic timepiece according to claim 1, wherein when the ticking timing of the clock unit is adjusted and changed, the first processor causes a first synchronization state signal to indicate no synchronization between that the ticking timing of the clock unit and a count-up timing of the timer circuit, and wherein the first processor is configured to output the synchronization request signal at a ticking timing of the clock unit when the first synchronization state signal indicates no synchronization at said ticking timing, thereby outputting the synchronization request signal to the second processor at the next ticking timing of the clock unit that occurs after the change of the ticking timing.

3. The electronic timepiece according to claim 2, wherein when the first synchronization state signal indicates no synchronization, the second processor causes a second synchronization state signal to indicate no synchronization between the ticking timing of the clock unit and the count-up timing of the timer circuit, wherein upon receipt of the synchronization request signal from the first processor, the second processor resets the timer circuit so that the timer circuit starts the new count of pulses in the clock signal and changes the second synchronization state signal to now indicate synchronization between the ticking timing of the clock unit and the count-up timing of the timer circuit, wherein when the second synchronization state signal indicates synchronization, the first processor changes the first synchronization state signal to now indicate synchronization between the ticking timing of the clock unit and the count-up timing of the timer circuit, and wherein when the first synchronization state signal is changed to indicate synchronization between the ticking timing of the clock unit and the count-up timing of the timer circuit, and thereafter when the timer circuit that has been reset counts up the prescribed number of pulses in the clock signal, the second processor causes the liquid crystal driver circuit to invert the polarity of the AC voltage and apply the inverted AC voltage to the liquid crystal panel.

4. The electronic timepiece according to claim 3, wherein the second processor further determines whether a timing at which the polarity of the AC voltage should be inverted due to the timer circuit having counted up the prescribed number of pulses is within a data transfer period during which image data is being output to the liquid crystal panel, and if said timing is within the data transfer period, said timing is changed to a timing that will occur after said data transfer period ends.

5. The electronic timepiece according to claim 2, wherein the second processor further determines whether a timing at which the polarity of the AC voltage should be inverted due to the timer circuit having counted up the prescribed number of pulses is within a data transfer period during which image data is being output to the liquid crystal panel, and if said timing is within the data transfer period, said timing is changed to a timing that will occur after said data transfer period ends.

6. The electronic timepiece according to claim 1, wherein the second processor further determines whether a timing at which the polarity of the AC voltage should be inverted due to the timer circuit having counted up the prescribed number of pulses is within a data transfer period during which image data is being output to the liquid crystal panel, and if said timing is within the data transfer period, said timing is changed to a timing that will occur after said data transfer period ends.

7. A method of display control performed by an electronic timepiece that includes:

a clock unit that keeps time, the clock unit repeatedly and periodically generating a ticking event at a prescribed ticking timing, the prescribed ticking timing being adjustable so as to correct the time kept by the clock unit;

a first processor that controls the clock unit;

a clock generation circuit that outputs a clock signal of a prescribed frequency in accordance with every ticking timing of the clock unit;

a timer circuit that repeatedly counts pulses in the clock signal output from the clock generation circuit up to a prescribed number of pulses that corresponds to the prescribed frequency;

a liquid crystal driver circuit that drives a liquid crystal panel; and a second processor that controls the timer circuit and the liquid crystal driver circuit, the method comprising:

via the second processor, causing the liquid crystal driver circuit to invert a polarity of an AC voltage to be applied to the liquid crystal panel and apply the inverted AC voltages to the liquid crystal panel each time the timer circuit counts up the prescribed number of pulses in the clock signal;

when the ticking timing of the clock unit is adjusted and changed, causing the first processor to output a synchronization request signal to the second processor at a next ticking timing of the clock unit that occurs after the change in the ticking timing, so as to request the second processor to perform resynchronization; and causing the second processor, upon receipt of the synchronization request signal from the first processor, to reset the timer circuit so that the timer circuit starts a new count of pulses in the clock signal.

8. A computer-readable non-transitory storage medium having stored a program executable by an electronic timepiece that includes:

a clock unit that keeps time, the clock unit repeatedly and periodically generating a ticking event at a prescribed ticking timing, the prescribed ticking timing being adjustable so as to correct the time kept by the clock unit;

a first processor that controls the clock unit;

a clock generation circuit that outputs a clock signal of a prescribed frequency in accordance with every ticking timing of the clock unit;

a timer circuit that repeatedly counts pulses in the clock signal output from the clock generation circuit up to a prescribed number of pulses that corresponds to the prescribed frequency;

a liquid crystal driver circuit that drives a liquid crystal panel; and a second processor that controls the timer circuit and the liquid crystal driver circuit, the program being configured to cause the electronic timepiece to perform the following:

via the second processor, causing the liquid crystal driver circuit to invert a polarity of an AC voltage to be applied to the liquid crystal panel and apply the inverted AC voltages to the liquid crystal panel each time the timer circuit counts up the prescribed number of pulses in the clock signal;

when the ticking timing of the clock unit is adjusted and changed, causing the first processor to output a synchronization request signal to the second processor at a next ticking timing of the clock unit that occurs after the change in the ticking timing, so as to request the second processor to perform resynchronization; and causing the second processor, upon receipt of the synchronization request signal from the first processor, to reset the timer circuit so that the timer circuit starts a new count of pulses in the clock signal.

* * * * *